US005718412A

United States Patent [19]

Levanas

[11] Patent Number: 5,718,412

[45] Date of Patent: Feb. 17, 1998

[54] PORTABLE SKATING RAIL

[76] Inventor: Ronald Levanas, 3124 Princeton, Dallas, Tex. 75205

[21] Appl. No.: 652,789

[22] Filed: May 23, 1996

[51] Int. Cl.[6] ..... E04H 17/00

[52] U.S. Cl. ..... 256/1; 256/59; 256/64; 472/89

[58] Field of Search ..... 256/59, 65, 60, 256/63, 64, 67, 13.1, 1; 472/88, 89, 90

[56] References Cited

U.S. PATENT DOCUMENTS

| | | | |
|---|---|---|---|
| 1,547,225 | 7/1925 | Marks | 256/64 X |
| 1,838,151 | 12/1931 | Penote | 256/64 |
| 3,148,746 | 9/1964 | Juculano | 256/59 X |
| 3,285,576 | 11/1966 | Clark | 256/65 X |
| 3,323,781 | 6/1967 | Murdock | 256/67 |
| 3,705,709 | 12/1972 | Andriussi | 256/59 X |
| 3,787,033 | 1/1974 | Snyder et al. | 256/65 X |
| 4,557,467 | 12/1985 | Lin | 256/59 |

FOREIGN PATENT DOCUMENTS

| | | | |
|---|---|---|---|
| 1429581 | 1/1966 | France | 256/65 |

*Primary Examiner*—Harry C. Kim
*Attorney, Agent, or Firm*—Wendy K. Buskop; Chamberlain, Hrdlicka et al.

[57] ABSTRACT

A modular series of square or tubular rails are joined to together by rigid or flexible connectors to provide a playing surface in-line skates and skateboards. The rails are separated from the earth or other surface by support columns. The rails themselves can be straight, curved, or can be equipped with a number of bends. Single column supports are preferred for permanent installations where the column can be bolted onto a surface or can be partially buried in the earth. Dual-column supports that form a triangular pattern that enable the rails system to be portable, yet allows skaters to impart horizontal as well as vertical loads on the rails safetly. Both columns allow the use of tubular or rectangular rails. Joints between the rail may be flexible to allow a broader range of skating maneuvers.

6 Claims, 3 Drawing Sheets

PORTABLE SKATING RAIL

BACKGROUND OF THE INVENTION

1. Field of the Invention

The present invention relates to rails. More particularly, the present invention relates to rails systems for skateboards and in-line skates so that operators of skateboards and in-line skates can safely slide down a pre-defined path.

2. Description of the Related Art

Skateboards, as toys, have been in the public domain for many years. The typical skateboard consists of a platform, usually made of wood or plastic, upon which the operator stands. Underneath the platform, the skateboard has at least four wheels on two separate axels. Essentially, the arrangement of platform and wheels makes the skateboard into an unpowered light vehicle for transportation and amusement. In recent years, so called "in-line" skates have appeared. The in-line skates have three or four wheels aligned along a single axis parallel to the operator's foot. So arranged, the in-line skates allow a greater range of maneuvers than conventional four-wheel skates. With the advent of lightweight, highly maneuverable skateboards and in-line skates, young adults have begun to performed more unusual and intricate skating feats. These youths have adopted common civic features, such as hand-rails for stairways, into their skating routines. In particlary, in-line skaters have used hand rails for a particular maneuver called a "disaster." A "disaster" occurs when the skater jumps down to the far end of the rail. However, in many cases, those same hand rails are used as a guard rail to prevent pedestrians from falling into ditches or other dangers. Consequently, the employment of stairway hand-rails and motorway guard-rails for this type of skating is profoundly unsafe. Although civil authorities have tried to discourage misuse of these civic safety features, they are unable to prevent misuse and injury by determined youths. There is, therefor, a need in the art for a railing system that allows skaters to perfect their art in a safe manner.

OBJECTS OF THE INVENTION

It is an object of the present invention to enable skating enthusiasts to include rail-based maneuvers into aggressive skating routines in a safer environment. It is a further object of the present invention to enhance skating maneuvers with a flexible railing system. It is also an object of the invention to provide a skating rail that can be easily transported and assembled in different locations.

SUMMARY OF THE INVENTION

The present invention solves the shortcommings in the prior art. The present invention consists of a modular series of square or tubular rails that are joined to together by rigid or flexible connectors. The rails are separated from the earth or other surface by support columns. The rails themselves can be straight, curved, or can be equipped with a number of bends.

The support columns come in two basic varieties: a single column which is bolted onto the surface or which is partially buried in the earth; and a portable version of double columns in a triangular pattern. The portable version allows the railing system to be disassembled, moved, and reassembed in another location. The single column version is preferred for permanent installations. The columns support vertical and horizontal loads imparted by the skaters. The columns also allow the use of tubular or square rails. The choice of tubular or square rails depends upon the type of maneuver desired and the use of either a skateboard or in-line skates. In the preferred embodiment of the present invention, the joints between the rail are allowed to flex a predetermined amount. The flexing of joints between rail modules allows for a greater degree of freedom by the skater and greatly broadens the range of maneuvers available.

DETAILED DESCRIPTION OF THE PREFERRED EMBODIMENTS

Figure 1:
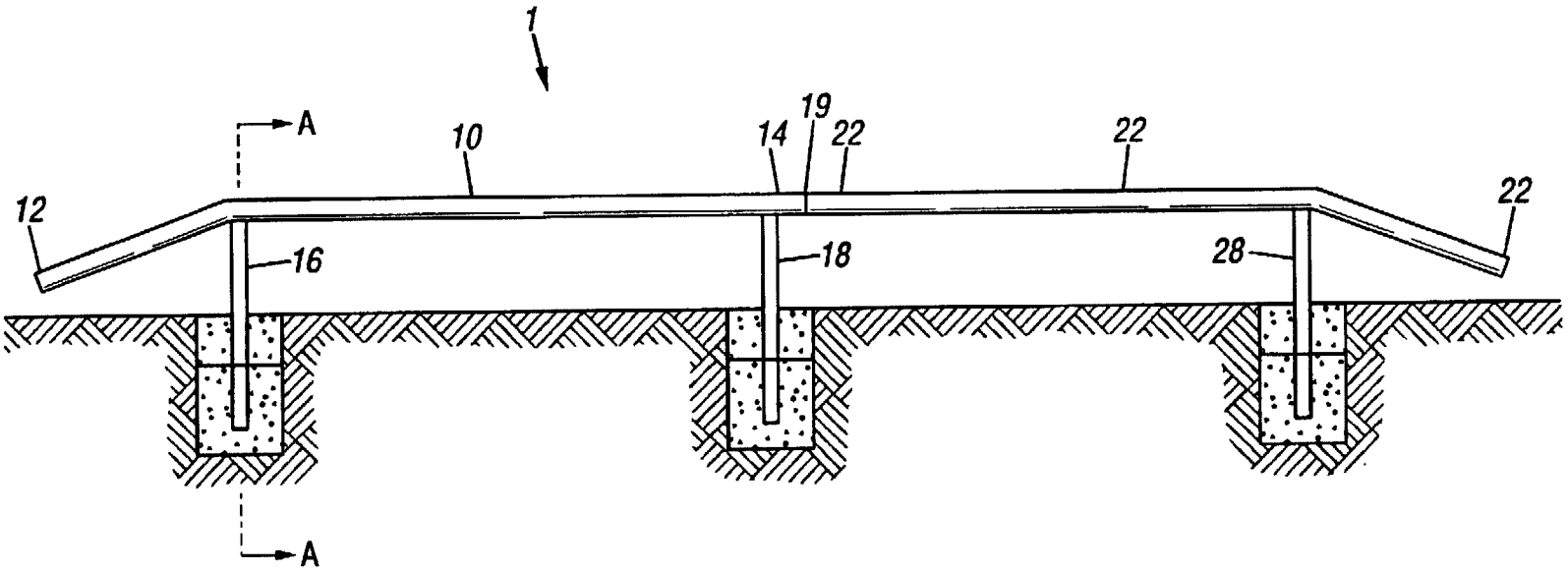
FIG. 1 shows a side view of the present invention with the supporting columns set in concrete.
Figure 2:
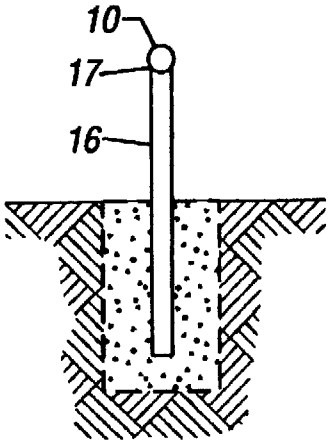
FIG. 2 shows a cross sectional view of a support column at section A—A of FIG. 1.

FIG. 1 shows a side view of an alternate embodiment of the rail system 1 of the present invention. The rail system 1 has a first rail section 10, a second rail section 20. The first rail section 10 has a longitudinal axis 13, a first end 12 and a second end 14. The first rail section 10 is supported on its first end 12 by support column 16 and on its second end 14 by support column 18. The first rail section 10 is fixedly connected, coaxially, to second rail section 20 at joint 19. Second rail section 20 is supported at its first end 22 by first rail section 10, and at its second end 24 by support column 28. In this embodiment, meant for permanent installation of the present invention, the support columns 16, 18, and 28 are partially buried in holes in the earth which are then filled with concrete as shown in FIG. 2.

Figure 3:
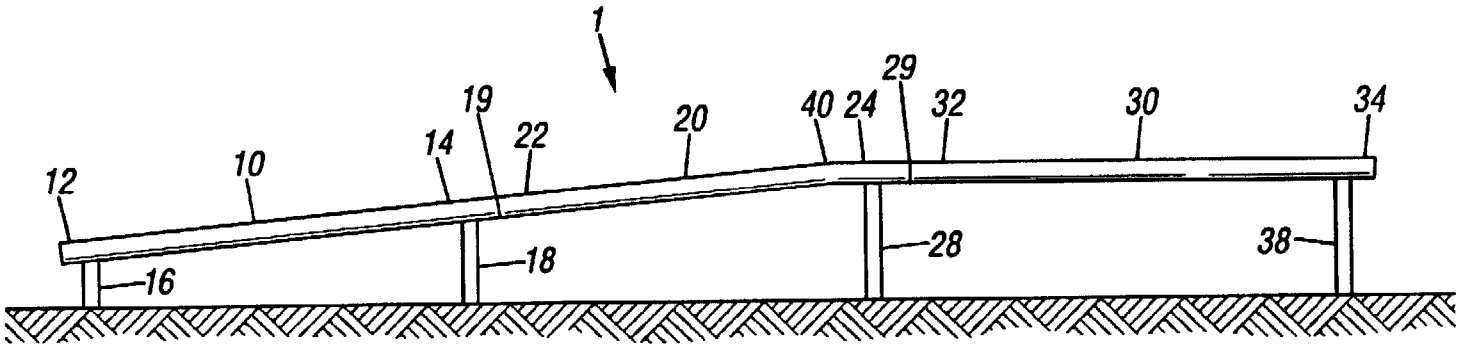
FIG. 3 shows a side view of an alternate embodiment of the present invention.

FIG. 3 shows a side view of an alternate embodiment of the rail system 1 of the present invention. The rail system 1 has a first rail section 10, a second rail section 20, and a third rail section 30. The first rail section 10 has a first end 12 and a second end 14. The first rail section 10 is supported on its first end 12 by support column 16 and on its second end 14 by support column 18. The first rail section 10 is fixedly connected to second rail section 20 at joint 19. Second rail section 20 is supported at its first end 22 by first rail section 10, and at its second end 24 by support column 28. Third rail section 30 is fixedly connected to second rail section 20 at joint 29. Third rail section 30 is supported at its first end 32 by second rail section 20, and at its second end 34 by support column 38.

Figure 5:
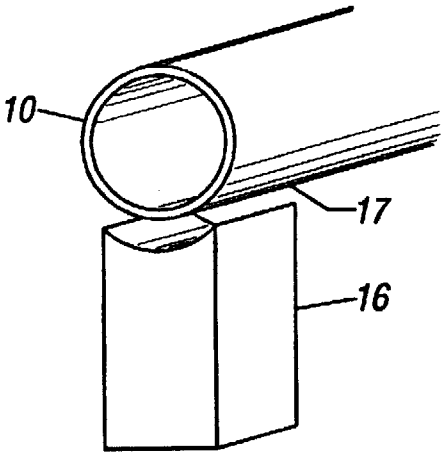
FIG. 5 shows an exploded perspective view of a fixedly attached rail/column interface of the present invention.
Figure 7:
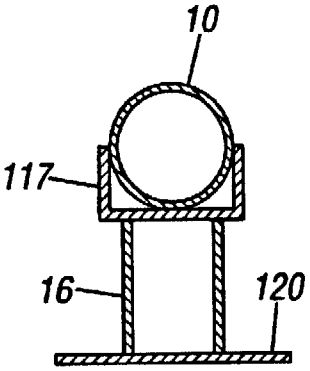
FIG. 7 shows a cross sectional view of a removably attached rail/column interface of the present invention.
Figure 6:
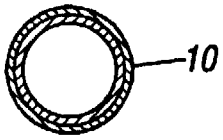
FIG. 6 shows a cross sectional view of a tubular rail of the present invention.
Figure 10:
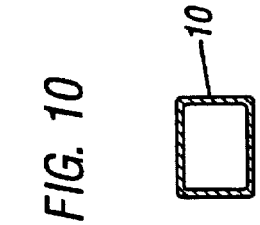
FIG. 10 shows a cross sectional view of a square rail alternate embodiment of the present invention.

The rail may fixedly or removably attached to its supporting columns. Fixed attachments are preferred for permanent installation of the present invention. Removably attached supporting columns allow the invention to be disassembled and later reassembled in another location, thus making the invention portable. A fixed attachment is shown in FIG. 5 where support column 16 is shown as a rectangular tube which is "coped" to recieve a tubular rail section 10. A cross section of a typical tubular rail 10 is shown in FIG. 6. A cross sectional view of a tubular rail 10 fitted within a channel 117 is shown in FIG. 7. A cross section of a rectangular rail 10 is shown in FIG. 10. The use of a rectangular or a tubular rail cross section depends upon the type of skating maneuver desired or the stability desired by the skater. Rectangular rails tend to provide a more stable surface for the skater but do not facilitate the freedom of maneuver that tubular rails provide.

Figure 4:
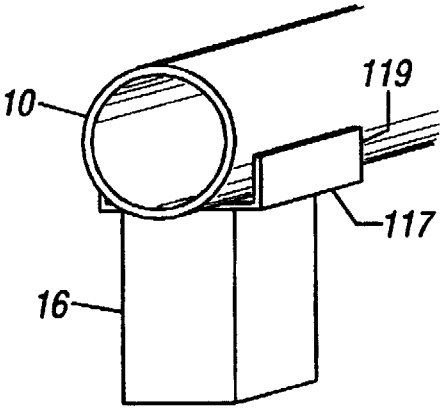
FIG. 4 shows a perspective view of a removably attached rail/column interface of the present invention.

The removably attached column is shown in FIG. 4. In this instance, channel 117 is fixed to support column 16 by welding, bolting, or equivalent means. Rail 10 is placed within channel 117. The sides 119 of channel 117 must be high enough so that rail 10 is not dislodged from channel 117 when a horizontal load is applied to rail 10.

Figure 8:
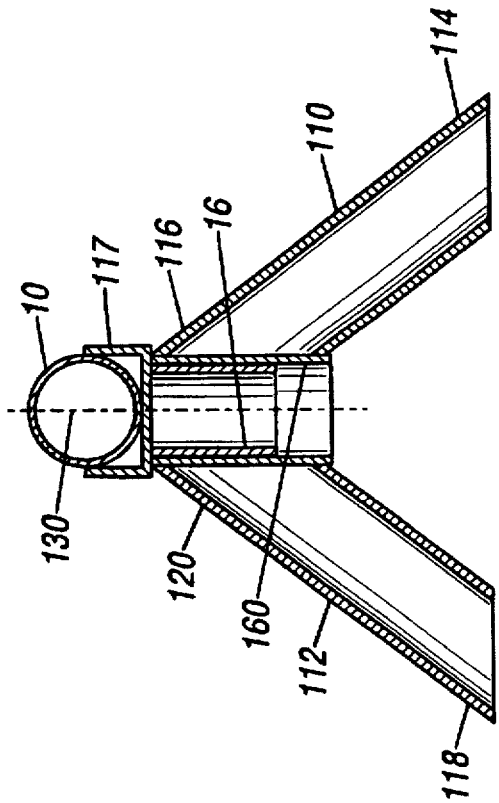
FIG. 8 shows a cross sectional view of a removably attached rail/column interface with a V-shaped support column of an alternate embodiment of the present/invention.

As shown in FIG. 2, the height of each support column can vary. Varying the hights of the support columns are necessary for certain skating maneuvers. This requires that bends be placed in some of the rail sections such as bend 40 shown in FIG. 3. To accomodate larger bends or increased vertical separation from the ground, while still retaining the portability feature of the present invention, a "V" shaped support column is provided. FIG. 8 shows a "V" shaped support column having a first leg 110 and a second leg 112. The "V" shape forms a vertical axis 130 as shown in FIG. 8. The first leg 110 has a lower end 114 and an upper end 116. Similarly, the second leg 112 has a lower end 118 and an upper end 120. The upper end 114 of the first leg 110 is joined to the upper end 118 of the second leg 112 by the connector element 160 as shown in FIG. 8. Connector element 160 can be shaped in tubular or polygonal cross sections so that a tubular or polygonal support column 16 can be fitted within connector element 160. Typically, all of support column 16 is fitted within connector element 160 so that only channel 117 and rail section 10 rest upon connector element 160. The arrangement of first leg 110 and second leg 112 into a "V" shape enables this support column to accomodate both vertical and horizontal loads imparted by the skaters.

Figure 9:
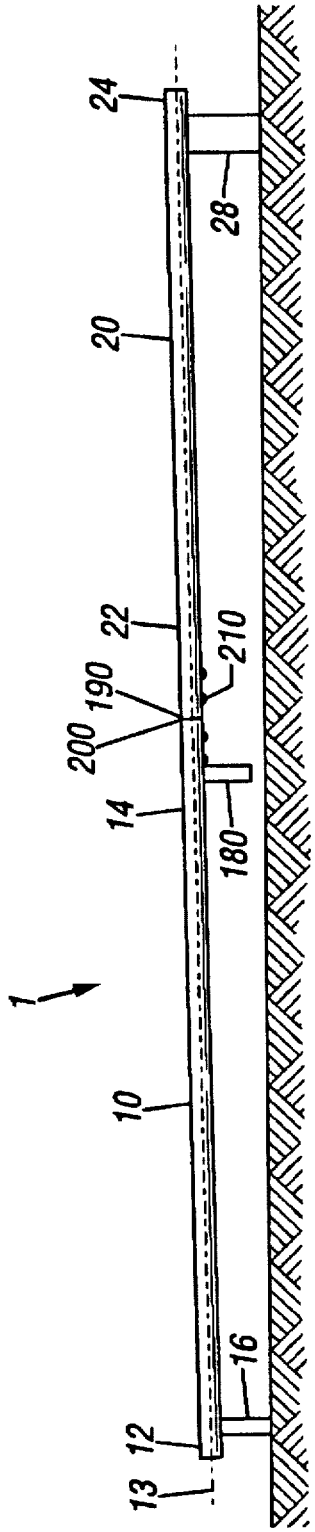
FIG. 9 shows a side view of the preferred embodiment of the present invention.

The preferred embodiment of the present invention is shown in FIG. 9. The rail system 1 has a first rail section 10, a second rail section 20. The first rail section 10 has a first end 12 and a second end 14. The first rail section 10 is supported on its first end 12 by support column 16. The first rail section 10 is flexibly connected to second rail section 20 at joint 190. Second rail section 20 is supported at its second end 24 by support column 28. In this preferred embodiment, meant for either portable or permanent installation, support column 180 is fixedly attached to the second end 14 of rail section 10. The height of support column 180 is less than the height from the surface to the rail section 10 when no load is applied to rail section 10 or rail section 20. Rail section 10 and rail section 20 are connected by a sleeve 200. The sleeve 200 can be made of steel and may be in the form of a steel tube that fits within the end sections 14 and 22 of rail sections 10 and 20, respectively. Similarly, a flexible sleeve 200 may be made of hard rubber that fits within the end sections 14 and 22 in a manner similar to the steel sleeve. In either case, the sleeve 200 can be fixedly attached to rail sections 10 and 20 with fasteners 210. The fasteners 210 can be in the form of pins or bolts.

By height of support column 180 and the flexibility of flexible sleeve 200 allows the bending of the rail system 1 at joint 190. This bending have a vertical and horizontal component, depending upon the design and arrangment of flexible sleeve 200 at joint 190. The bending and flexing of the rail system provides the skaters with a wider variety of dynamic and aggressive skating maneuvers.

Although the present invention has been characterized in terms of the above-described presently preferred embodiment, it will be recognized by those skilled in the art who have the benefit of this disclosure that certain changes and variations may be made to that embodiment without departing from the spirit of the present invention. The present invention is not limited to the above-described presently preferred embodiment, and it is expectec that such variations will be encompassed within the scope of the following claims.

What is claimed is:

1. An apparatus comprising:

a first rail section having a first end and a second end;

a first support means for separating said first end of said first rail section from a surface, said first support means is fixedly attached to said first rail section, said first support means has a height;

a second support means for separating said second end of said first rail section from said surface, said second support means is fixedly attached to said first rail section, said second support means has a height;

a second rail section having a first end and a second end;

a third support means for separating said first end of said second rail section from said surface, said second rail section is removably attached to said third support means, said third support means has a height;

a fourth support means for separating said second end of said second rail section from said surface, said second rail section is removably attached to said fourth support means, said fourth support means has a height;

a connector means for connecting said second end of said first rail section with said first end of said second rail section;

said height of said third support means is greater than said height of said first support means and said second support means;

said height of said fourth support means is greater than said height of said first support means and said height of said second support means;

said third support means has a first leg a second leg, and a third connector element, each of said legs has an upper end and a lower end, said upper end of said first leg begin joined to said upper end of said second leg by said third connector element to form an inverted "V" shaped structure having an apex and a vertical axis, wherein said third support means is removably attached to said second rail by said third connector element;

said fourth support means has a first leg, a second leg, and a fourth connector element, each of said legs has an upper end and a lower end, said upper end of said first leg being joined to said upper end of said second leg by said fourth connector element to form an inverted "V" shaped structure having an apex and a vertical axis, wherein said fourth support means is removably attached to said second rail by said fourth connector element;

each of said connector elements is formed from a tubular member having an upper end and a lower end and a longitudinal axis extending from said upper end to said lower end, wherein said longitudinal axis of said tubular member coincides with said vertical axis of said inverted "V" shaped structure, wherein each of said tubular members has an opening at said upper end and an inside surface which has a polygonal cross section in a plane normal to said longitudinal axis of said tubular member;

wherein said second rail section has an upper surface, a lower surface, a first pin extending generally normally from said lower surface, and a second pin extending generally normally from said lower surface, wherein said first pin is positioned between said second pin and said first end of said second rail section and said second pin is positioned between said first pin and said second end of said rail section, each of said first pin and said second pin having a longitudinal axis and an outer surface which has a polygonal cross section in a plane normal to said longitudinal axis of said pin, wherein said first pin is closely received by said tubular member of said third connector element to form a first connector element and said second pin is closely received by said tubular member of said fourth connector element to form a second connector element.

2. An apparatus as in claim 1 wherein said second rail section is positioned in a first generally vertical plane, said third support means is positioned in a second generally vertical plane which forms a substantially right angle with said first generally vertical plane, and said fourth support means is positioned in a third generally vertical plane which is spaced apart from said second generally vertical plane and forms a substantially right angle with said first generally vertical plane.

3. An apparatus as in claim 2 wherein said first rail section and said second rail section are formed from tubular members having the same outside diameter.

4. An apparatus as in claim 3 wherein a first opening is defined at said second end of said first rail section and a second opening is defined at said first end of said second rail section and said connector means for connecting said second end of said first rail section with said first end of said second rail section comprises a post closely received in said first opening and said second opening.

5. An apparatus as in claim 4 wherein said second rail section defines a bend.

6. An apparatus as in claim 5 wherein said first rail section defines a bend.

* * * * *